US007171701B2

(12) United States Patent
Kuster et al.

(10) Patent No.: US 7,171,701 B2
(45) Date of Patent: Feb. 6, 2007

(54) PRESSURE-FLUSHING DEVICE

(75) Inventors: Rolf Kuster, Rapperswil (CH); Peter Reichmuth, Wolfhausen (CH)

(73) Assignee: Geberit Technik AG, Jona (CH)

( * ) Notice: Subject to any disclaimer, the term of this patent is extended or adjusted under 35 U.S.C. 154(b) by 0 days.

(21) Appl. No.: 11/251,927

(22) Filed: Oct. 18, 2005

(65) Prior Publication Data

US 2006/0107451 A1 May 25, 2006

(30) Foreign Application Priority Data

Nov. 19, 2004 (EP) ..... 04405717

(51) Int. Cl.
*E03D 3/10* (2006.01)

(52) U.S. Cl. ..... 4/354; 4/359; 4/362

(58) Field of Classification Search ..... 4/354, 4/359, 360–362

See application file for complete search history.

(56) References Cited

U.S. PATENT DOCUMENTS 1,338,638 A 4/1920 Knell
3,566,416 A 3/1971 Altieri et al.
3,890,651 A 6/1975 Wood et al.
5,361,426 A * 11/1994 Martin ..... 4/361
5,857,224 A 1/1999 Oberg et al.
5,970,527 A * 10/1999 Martin et al. ..... 4/361
6,343,387 B1 * 2/2002 Beh ..... 4/354
6,360,378 B2 * 3/2002 Martin ..... 4/359
6,457,187 B1 10/2002 Anderson et al.
6,550,076 B1 * 4/2003 Fish ..... 4/359
6,907,623 B2 * 6/2005 Beh ..... 4/354
2001/0034903 A1 11/2001 Martin

FOREIGN PATENT DOCUMENTS

WO WO 2004/033808 A1 4/2004

* cited by examiner

*Primary Examiner*—Khoa D. Huynh
(74) *Attorney, Agent, or Firm*—Sughrue Mion, PLLC

(57) ABSTRACT

The pressure-flushing device comprises a pressure vessel (2), which, for receiving flushing water, has a pressure chamber (D). The pressure chamber (D) can be filled with flushing water by means of an inlet valve (7). The pressure chamber (D) consists of cylindrical pressure chamber regions (D1, D2, D3) which are interconnected in a lower region of the pressure vessel (2). The pressure chamber regions (D1, D2, D3) are preferably formed by cylindrical walls (Z1, Z2, Z3), these walls being essentially circular in horizontal section. The pressure vessel (2) can be made from plastic and is both pressure-stable and compact.

7 Claims, 3 Drawing Sheets

PRESSURE-FLUSHING DEVICE

The invention relates to a pressure-flushing device with a pressure vessel, which, for receiving flushing water, comprises a pressure chamber, with an inlet valve, by means of which the pressure vessel can be filled with flushing water, with an outlet valve and with an actuating element for initiating a flush.

Pressure-flushing devices of the said type have become known from WO 2004/033808 and U.S. Pat. No. 5,857,224, for example, and have proved themselves per se. In a pressure-flushing device of the said type, the flushing water is stored under a pressure of 1.5 to 2.5 bar, for example. The pressure is maintained by one or more air chambers located in the pressure vessel above the flushing water. After initiation of a flush, the flushing water flows through an opening in the bottom of the pressure vessel into the toilet bowl. After flushing, the pressure vessel is automatically filled with flushing water again. The flushing water is introduced into the pressure vessel from a pressure line by means of the inlet valve. During this operation, the air present in the pressure vessel is compressed and the desired pressure is thus built up. Initiation of the flush is effected, for example, by actuating a button or even without contact.

Compared with flushing devices in which the flushing water flows into the toilet bowl on account of gravity alone, pressure-flushing devices have the advantage that the flushing water can be delivered at higher speed and thus more effectively. The greater speed of the flushing water makes a greater cleaning effect possible. It is a disadvantage of pressure-flushing devices, however, that, on account of the comparatively high pressure in the pressure vessel, this has to be of correspondingly stable design. This is not readily achievable in particular when the pressure vessel is made of plastic.

In the pressure-flushing device according to the said U.S. Pat. No. 5,857,224, the pressure vessel is made from two housing parts, which are interconnected by friction welding. In this case, the two housing parts are preferably made of plastic. For reinforcement, inner walls are provided, which extend through the lower housing part and in each case interconnect a front wall and a rear wall. This is intended to provide the pressure vessel with strength and stability. It is disadvantageous that the production of such a pressure vessel is comparatively costly. It has also been found that wall regions can bend outwards when pressure vessels are in the filled state, which is undesirable.

The object of the invention is to provide a pressure cistern of the said type which avoids the said disadvantages. It is consequently to be possible to make the pressure-flushing device from plastic with increased pressure resistance.

The object is achieved in a pressure-flushing device of the said type by virtue of the fact that the pressure chamber consists of cylindrical pressure chamber regions which are interconnected in a lower region of the pressure vessel. This design of the pressure chamber regions makes it possible to avoid flat side walls. The cylindrical pressure chamber regions preferably extend over more than half the overall height of the pressure vessel. At least two cylindrical pressure chamber regions preferably extend over more than two thirds of the height of the pressure vessel. The said pressure chamber regions are preferably circular in cross section. This makes it possible to guarantee pressure loads on the wall of the pressure vessel which are essentially the same all over. Undesirable bulging can thus be avoided. The pressure vessel can moreover be made compactly from plastic.

According to a development of the invention, the pressure vessel consists of a vessel upper part and a vessel lower part, which parts are interconnected tightly. The cylindrical pressure chamber regions are formed by the vessel upper part. The connection between the vessel upper part and the vessel lower part is preferably located in the lower third and preferably in the lower quarter of the pressure vessel.

The vessel lower part forms a connecting duct which connects the cylindrical pressure chamber regions. Seen in cross section, this connecting duct is essentially semicircular downwards. Flat side walls are thus avoided in the bottom region as well. The connecting duct preferably interconnects three cylindrical pressure chamber regions. Both the vessel upper part and the vessel lower part are preferably made from plastic, by injection moulding for example. These two parts are interconnected tightly, by friction welding or hot gas for example.

Three cylindrical pressure chamber regions are preferably arranged next to one another. The central pressure chamber region preferably serves for mounting and accommodating the inlet valve, the outlet valve and the actuating element.

For further reinforcement, it is proposed that reinforcing ribs are arranged on the outside between at most two cylindrical pressure chamber regions. These reinforcing ribs are preferably in each case formed on an intermediate wall and located in an indentation.

Further advantageous features emerge from the dependent patent claims, the description below and the drawing.

An illustrative embodiment is explained in greater detail below with reference to the drawing, in which.

Figure 2:
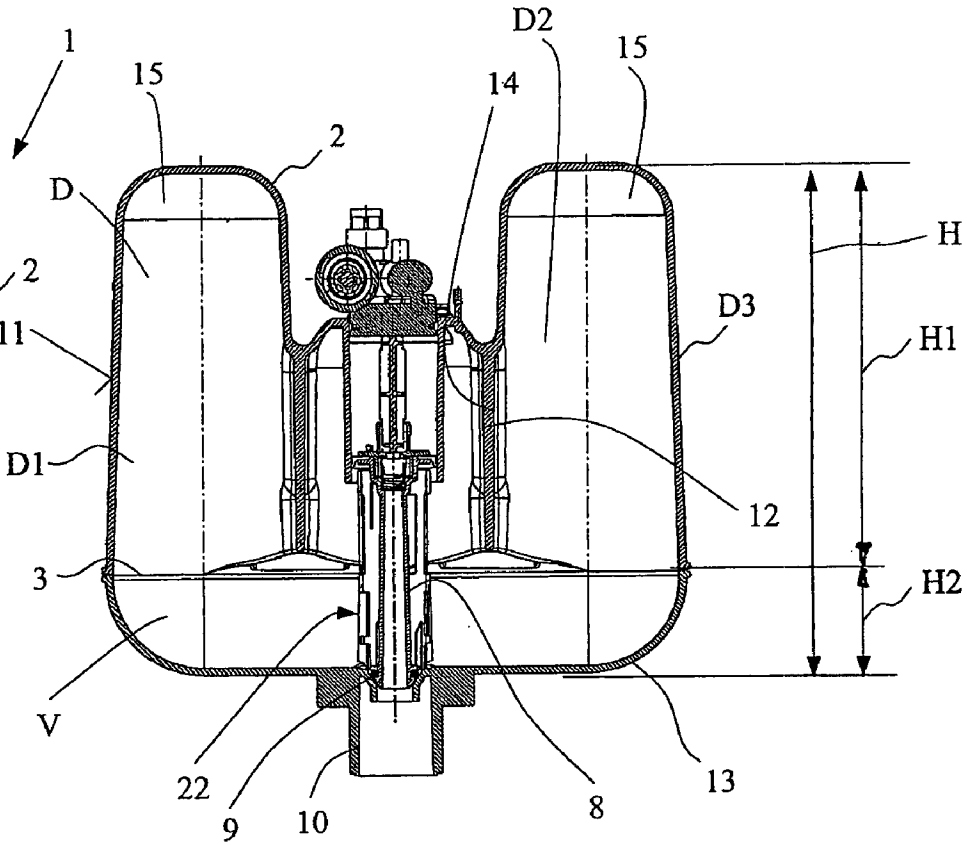
FIG. 2 shows a section through the pressure-flushing device along the line II—II in FIG. 7.
Figure 1:
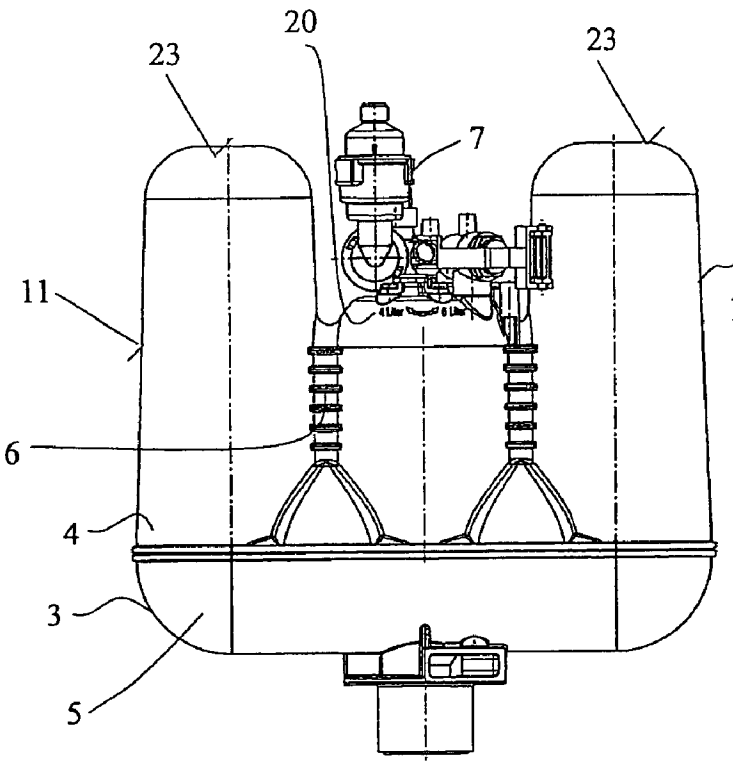
FIG. 1 shows a view of the pressure-flushing device according to the invention.
Figure 4:
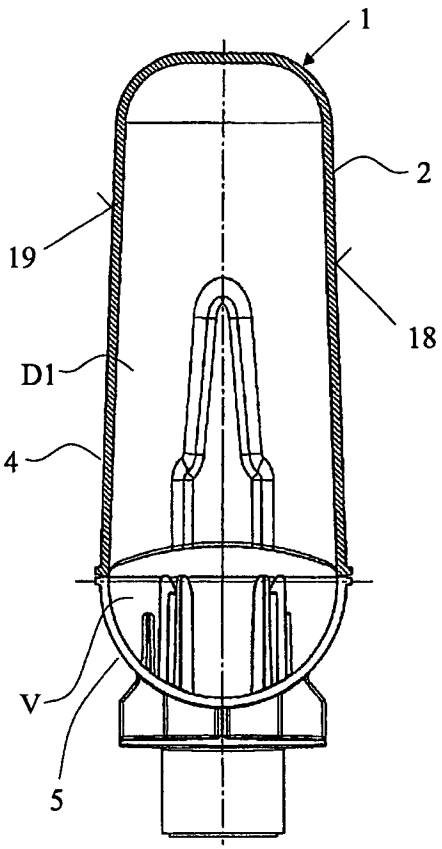
FIG. 4 shows a section along the line IV—IV in FIG. 3.
Figure 3:
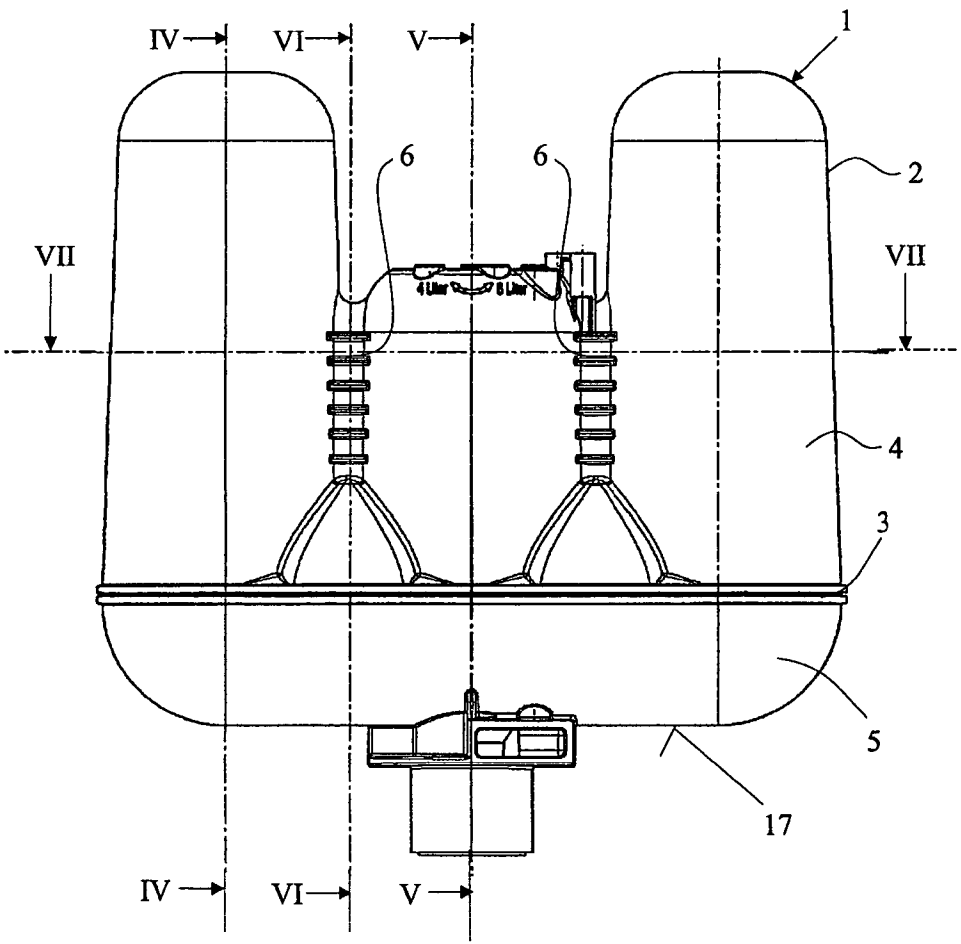
FIG. 3 shows another view of the pressure-flushing device, in which parts are omitted.

According to FIG. 1, the pressure-flushing device 1 comprises a pressure vessel 2, which is made from a vessel upper part 4 and a vessel lower part 5. The vessel upper part 4 and the vessel lower part 5 are produced by injection moulding, for example, and interconnected tightly in a lower region by means of a weld seam 3. A flushing neck 10, which on the inside forms a valve seat 9 for the outlet valve 22 illustrated in greater detail in FIG. 2, is formed centrally on the vessel lower part 5. The outlet valve 22 comprises a sealing body 8, which is lifted in a manner known per se for initiating a flush. After initiation of a flush, the flushing water present in the pressure vessel 2 is delivered through the flushing neck 10 via a flushing bend (not shown here) into a toilet bowl (likewise not shown here).

The outlet valve 22 is mounted on the vessel upper part 4. An inlet valve 7 known per se is likewise mounted on the vessel upper part 4. This valve is connected to a water pressure line (not shown here). When the inlet valve 7 is opened, water flows through a valve housing 14 shown in FIG. 2 into a pressure chamber D of the pressure vessel 2. During this operation, air in the pressure chamber D is compressed. A spring, which is loaded when the pressure vessel 2 is filled, can also be provided instead of air. When the pressure vessel 2 has been filled, the inlet valve 7 closes automatically. The compressed air is located in the upper regions 15 of the pressure chamber D shown in FIG. 2.

An actuating element 20, which has two buttons, is also mounted on the vessel upper part 4. When one of these buttons is pressed, a flush is initiated. A flush with four litres of flushing water is initiated with one button, for example, and a flush with six litres of flushing water with the other button. Other forms of actuation are also possible here, for example actuation without contact. Reference is also made here to WO 2004/033808 of the applicant for the original disclosure, in particular with regard to the inlet valve and the outlet valve.

The vessel upper part 4 is designed in such a way that three pressure chamber regions D1, D2 and D3 are formed. In horizontal cross section, these pressure chamber regions D1, D2 and D3 are in each case essentially circular over their entire height, as FIG. 7 in particular shows. According to FIG. 2, the cylindrical region extends from an upper side 23 to the weld seam 3. The corresponding height is indicated by H1 in FIG. 2. In relation to the overall height H, this height H1 is preferably more than half, preferably more than two thirds. The height H2 of the vessel lower part 5 is accordingly considerably smaller than half the height H, and is preferably about a quarter.

The pressure chamber regions D1, D2 and D3 are arranged in a line, the pressure chamber regions D1 and D3 being arranged on the outside and the pressure chamber region D2 in the centre between these. The pressure chamber regions D1 and D3 are essentially empty and serve for receiving the flushing water and the air in the regions 15. The central pressure chamber region D2 likewise serves for receiving flushing water and air, but at the same time also for accommodating the outlet valve 22. As can be seen, the central pressure chamber region D2 is less high than the two pressure chamber regions D1 and D3. According to FIG. 5, an upper side 23*a* of the central pressure chamber region D2 is accordingly located below the upper sides 23 of the pressure chamber regions D1 and D3.

Figures 5, 6, 7:
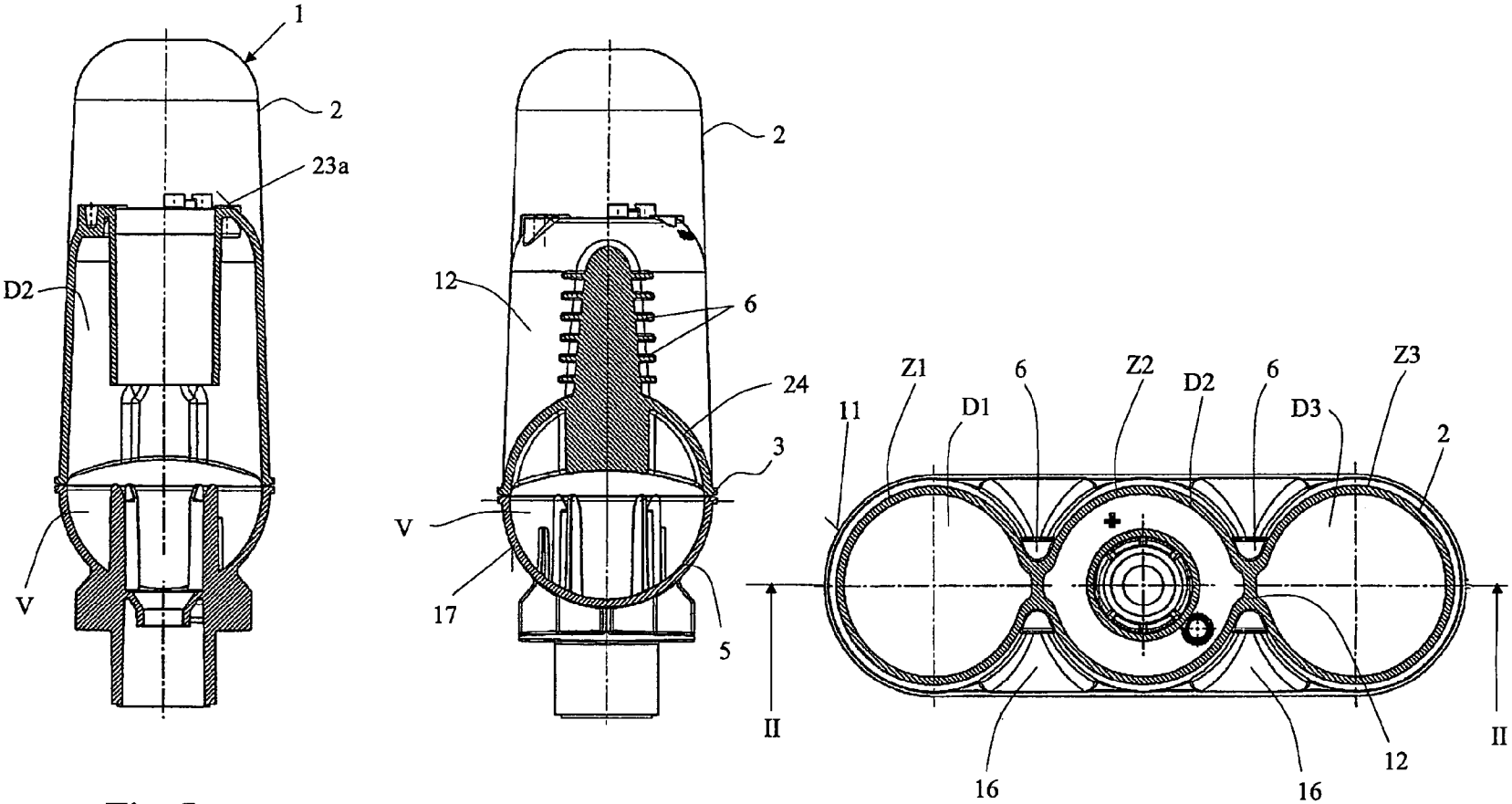
FIG. 5 shows a section along the line V—V in FIG. 3.
FIG. 6 shows a section along the line VI—VI in FIG. 3.
FIG. 7 shows a section along the line VII—VII in FIG. 3.

The pressure chamber regions D1, D2 and D3 are formed by corresponding walls Z1, Z2 and Z3, as shown in FIG. 7. These walls Z1, Z2 and Z3 are connected by two intermediate walls 12. These intermediate walls 12 preferably likewise extend essentially over the entire height of the pressure chamber D2. As can be seen, these intermediate walls 12 are comparatively narrow in their horizontal extension. These intermediate walls 12 reinforce the pressure vessel 2 by means of ribs 6, which are arranged on the outside in indentations 16 and in particular formed on. A number of ribs 6 arranged one above another are provided in each of the indentations 16. As FIG. 6 shows, a cross-sectionally quadrant-shaped wall 24, which is formed on the intermediate wall 12 and connected to the vessel lower part 5 via the weld seam 3, in each case follows the lowest of the ribs 6. Overall, this results in a circular vertical cross section, as FIG. 6 shows. Consequently, no plane walls, which may bulge outwards, are present in this vertical section either. The pressure load is also essentially the same all over here.

The connecting duct V interconnects the pressure chamber regions D1, D2 and D3, this connecting duct V essentially extending horizontally in the vessel lower part 5. The height H2 of this connecting duct V is considerably smaller than the height H1 of the vessel upper part 4, or of the pressure chamber regions D1 and D3. The connecting duct is essentially semicircular or circular in cross section.

A lower side 17 of the vessel lower part 5 is accordingly rounded on all sides. A front side 18 and a rear side 19 of the pressure vessel 2 have no plane wall regions either.

| LIST OF REFERENCES | |
|---|---|
| 1 | flushing device |
| 2 | pressure vessel |
| 5 | vessel lower part |
| 6 | reinforcing ribs |
| 7 | inlet valve |
| 8 | sealing body |
| 9 | valve seat |
| 10 | flushing neck |
| 11 | outer side |
| 12 | intermediate wall |
| 13 | bottom |
| 14 | valve housing |
| 15 | chamber region |
| 16 | indentation |
| 17 | lower side |
| 18 | front side |
| 19 | rear side |
| 20 | actuating element |
| 22 | outlet valve |
| 23 | upper side |
| 23a | upper side |
| 24 | wall |
| D | pressure chamber |
| D1 | pressure chamber region |
| D2 | pressure chamber region |
| D3 | pressure chamber region |
| Z1 | cylindrical wall |
| Z2 | cylindrical wall |
| Z3 | cylindrical wall |
| V | connecting duct |
| H | height |
| H1 | height |
| H2 | height |

The invention claimed is:

1. A pressure-flushing device comprising:

a pressure vessel for receiving flushing water, a pressure chamber;

an inlet valve, operative to fill the pressure vessel with flushing water, an outlet valve; and an actuating element for initiating a flush, wherein the pressure chamber consists of cylindrical pressure chamber regions, which are interconnected in a lower region of the pressure vessel, wherein three pressure chamber regions are arranged next to one another, wherein that three pressure chamber regions are formed by cylindrical walls, said walls being essentially circular in horizontal section, and wherein an intermediate wall which is comparatively narrow in its horizontal extensions is in each case arranged between two cylindrical walls.

2. The pressure-flushing device according to claim 1, wherein the pressure vessel comprises a vessel upper part and a vessel lower part, the said pressure chamber regions being formed by the vessel upper part.

3. The pressure-flushing device according to claim 2, wherein the vessel lower part forms a horizontally extending connecting duct which interconnects the said pressure chamber regions.

4. The pressure-flushing device according to claim 2, wherein the vessel lower part has a height which is considerably smaller than a height of the vessel upper part.

5. The pressure-flushing device according to claim 2, wherein the vessel lower part is of essentially semicircular design in vertical section.

6. The pressure-flushing device according to claim 1, wherein a central cylindrical pressure chamber region is provided, in which at least the outlet valve is mounted.

7. The pressure-flushing device according to claim 1, wherein a number of reinforcing ribs, which interconnect cylindrical walls, are arranged in a front side and/or a rear side, in each case in an indentation.

* * * * *